US006053237A

United States Patent [19]

Bertilsson et al.

[11] Patent Number: 6,053,237

[45] Date of Patent: Apr. 25, 2000

[54] BUMP-RESISTANT DOOR

[75] Inventors: Hans-Inge Bertilsson; Nils Håkan Ivar Larsson, both of Halmstad, Sweden

[73] Assignee: Nomafa AB, Halmstad, Sweden

[21] Appl. No.: 08/669,553

[22] PCT Filed: Jan. 17, 1995

[86] PCT No.: PCT/SE95/00036

§ 371 Date: Jul. 26, 1996

§ 102(e) Date: Jul. 26, 1996

[87] PCT Pub. No.: WO95/19486

PCT Pub. Date: Jul. 20, 1995

[30] Foreign Application Priority Data

Jan. 17, 1994 [SE] Sweden ..... 9400109

[51] Int. Cl.[7] ..... E05D 15/16

[52] U.S. Cl. ..... 160/205; 160/201

[58] Field of Search ..... 160/201, 133, 160/200, 205

[56] References Cited

U.S. PATENT DOCUMENTS

| | | | |
|---|---|---|---|
| 4,676,293 | 6/1987 | Hanssen | 160/201 |
| 4,953,608 | 9/1990 | Larsson . | |
| 5,163,494 | 11/1992 | MacNeil et al. | 160/201 |
| 5,271,448 | 12/1993 | Delgado . | |
| 5,584,333 | 12/1996 | Torchetti et al. | 160/201 |

FOREIGN PATENT DOCUMENTS 1072146 12/1959 Germany .

*Primary Examiner*—Blair Johnson
*Attorney, Agent, or Firm*—Kane, Dalsimer, Sullivan, Kurucz, Levy, Eisele and Richard, LLP

[57] ABSTRACT

The present invention relates to a door of the type having two parallel guide rails, a plurality of guide means (10, 50), which are adapted, when the door moves, to be guided by and run along the guide rails, a plurality of neighboring door leaf panels (2), which at opposite ends are connected to the associated guide means (10) of said plurality of guide means, and a bottom panel (4) which is pivotally connected to an adjoining panel (2) of said door leaf panels and, via releasable joints, connected to two associated bottom guide means (50) among said guide means. The invention is characterized in that the two bottom guide means (50) of the bottom panel (4) are each connected to an adjoining guide means (50) of a door leaf panel (2) adjoining the bottom panel (4), by means of coupling element (60), and that said releasable joints are arranged between said coupling element (60) on one hand and said bottom panel (4) on the other hand, such that said bottom panel (4), if subjected to such load that said joint is released, can swing outwards, while said coupling elements (60) and said bottom guide means (50) are kept in position relative to the remaining guide means (10) and door leaf panels (2).

8 Claims, 3 Drawing Sheets

BUMP-RESISTANT DOOR

The present invention relates to a bump-resistant door, more specifically a door comprising a plurality of successive panels, which at their opposite terminal edges are connected to guide rails via a plurality of guide means.

Doors of this type, such as overhead sliding doors, are frequently subjected to the risk of being bumped into or subjected to a similar impact, especially at the lower part of the door, when the door is almost open or partly closed. Such bumps or impacts can cause serious damage to the door and to the colliding object, such as a fork truck. In consequence, expensive repair work will be necessary and the door will be useless for some time, which can be especially problematic if the door is used as an exterior door.

U.S. Pat. No. 4,676,293 discloses, as a solution to the above-mentioned problem, an overhead sliding door in which the joint between the terminal edges of the bottom panel and the respective guide means is releasable in case of an impact, such that the bottom panel, when bumped into, can pivot laterally in one or the other direction, depending on the direction of impact. The guide means, which constitute joints between the terminal edges of the panels and the guide rails, consist of rollers which run in the guide rails and which are each connected, via a shaft, to hinges joining the panels. Each of the two bottom rollers in the respective guide rail is via a shaft connected to a respective bottom mounting element, which is fixedly mounted on the corresponding side of the bottom panel immediately above the lower edge of the bottom panel. To release the releasable joint, the bottom panel must, when bumped into, deflect laterally, such that the two side edges of the bottom panel are moved away from the respective guide rail. The increased distance which thus arises between the panel edge and the guide rail implies, provided that the deflection is sufficiently great, that the two terminal edges of the bottom panel are separated from the respective bottom roller by the corresponding shafts being axially moved outwards away from the associated bottom mounting element and being disengaged therefrom. Thus, the bottom panel must be sufficiently flexible to allow the requisite deflection when subjected to an impact.

To prevent, for reasons of security, the bottom panel from being laterally swung out when the door is completely closed, it is suggested that the horizontal lower edge of the bottom panel be provided with a rubber strip, which, on complete closing of the door, is firmly pressed against the base, thereby preventing rotation of the bottom panel.

Even if the solution according to U.S. Pat. No. 4,676,293 may confer certain advantages in impact resistance, compared with other constructions without a pivotable bottom panel, some deficiencies remain, which the present invention has for its object to eliminate.

One drawback of the door according to U.S. Pat. No. 4,676,293 is that it is not possible, which in many cases is preferred, to attach ropes or chains to the lowermost part of the bottom panel, for balancing/driving the door, since this lowermost part is swung out when bumped into. Moreover, the door cannot be used in combination with the type of safety devices as disclosed in, for instance, EP-B1-0 325 602, said safety device comprising signalling means extending below the lower edge of the bottom panel and adapted to emit a light beam or the like under and at a distance from the lower edge of the door, and said safety device being adapted to stop or reverse the door if said light beam is blocked by an object during the closing motion. If such a safety device should be mounted on the bottom panel of the door according to U.S. Pat. No. 4,676,293, the entire safety function would be eliminated as soon as the bottom panel swings aside. Moreover, electric wiring to such a safety device would be difficult to accomplish in a simple manner.

A further drawback of the door according to U.S. Pat. No. 4,676,293 is that, after the occurrence of an impact and the shaft of the respective bottom roller has slid out of its corresponding bottom mounting element, the two bottom rollers are completely separated from the door leaf as well as the guide rails and therefore can fall down and be damaged. This complete separation also implies that it will be complicated and time-consuming to restore the door to working order.

The door according to U.S. Pat. No. 4,676,293 also suffers from the drawback that the bottom panel must be flexible to make the release mechanism function, thereby restricting the field of application of the door.

The object of the present invention is to solve the above-mentioned problems of prior-art technique.

More specifically, the object of the invention is to provide a door of the type mentioned by way of introduction, which comprises a laterally pivotable bottom panel, but which still permits effective mounting of drive and balancing means allowing the mounting of safety devices of the type disclosed in the above-mentioned EP-B1-0 325 602, which is easy to restore to working order after being bumped into or subjected to a similar impact, and which renders it possible to manufacture the bottom panel in a rigid or less flexible design.

These objects are achieved by an overhead sliding door according to claim 1, preferred embodiments being defined in the accompanying independent claims.

The invention will now be described in more detail by means of a non-restrictive embodiment, reference being made to the accompanying drawings.

Figure 2:
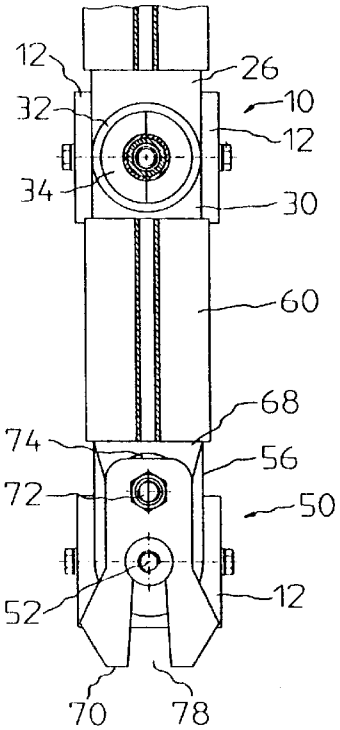
FIG. 2 is a side view corresponding to FIG. 1, taken along line II—II.1.
Figure 1:
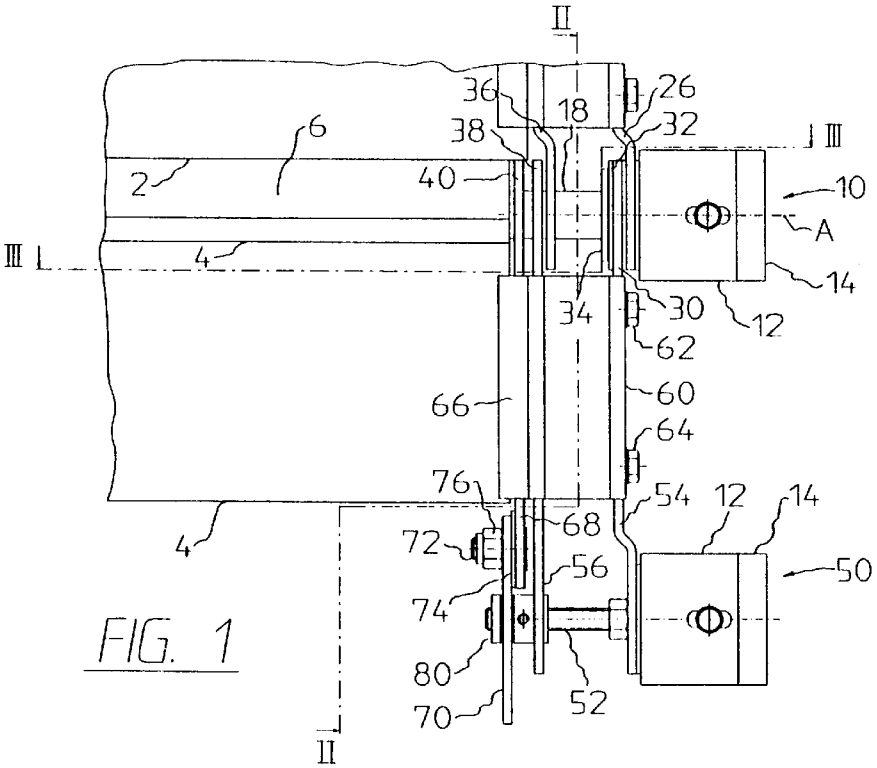
FIG. 1 is a broken-away front view of a lower part of an embodiment of an inventive door provided with a pivotable bottom panel.
Figure 3:
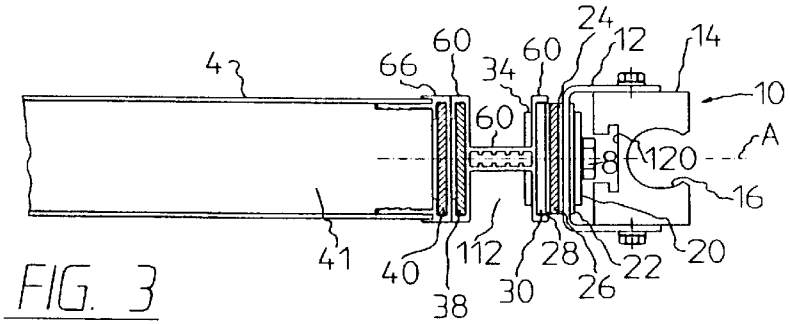
FIG. 3 is a top plan view corresponding to FIG. 1, taken along line III—III.

FIGS. 1–3, to which reference it first made, illustrate a lower side part of a door designed according to the invention. A corresponding, but inverted construction is to be found at the opposite side of the door.

FIG. 1 shows part of a door leaf panel 2, which adjoins a subjacent bottom panel 4. A link element 6, which is not described in more detail here, extends between the panels 2 and 4 and permits mutual rotation of the panels around the axis designated A. The link element is shown in a sectional view in FIG. 6 and is described in more detail in Applicant's Swedish patent application entitled "Door panel", which has the same filing date as the present application and to which reference is made for further description of the link element 6.

The extension of the link element 6 comprises a guide means 10 which is rotatable around the axis A and adapted to engage with and be guided by a guide rail (not shown). The guide means 10 comprises, as shown in FIG. 3, a U-shaped guide block bracket 12 screwed to a guide block 14. The block 14 is formed with a substantially cylindrical groove 16 to be able to be guided by and slide along the guide rail.

The base of the guide block bracket 12 is connected by means of a screw 8 with a hinge device joining the panels 2 and 4. The hinge device is mounted around a bush 18, which supports—from the right to the left starting from the guide means 10—a washer 20, a slideway lining 22, the guide block bracket 12, a slideway lining 24, a lower coupling plate 26, a slideway lining 28, an upper coupling plate 30, a slideway lining 32, a washer 34, a lower coupling plate 36, an upper coupling plate 38 and a hinge plate 40. Guide means identical with or similar to the guide means 10 are arranged at the corresponding link elements between other neighbouring panels along the rest of the door.

FIG. 1 further illustrates a bottom guide means 50 associated with the bottom panel 4 and comprising a guide block bracket 12 and a guide block 14 of essentially the same design as in the adjoining guide means 10. The guide means 50 is, by means of a screw 52, rotatably connected to two lower coupling plates 54 and 56.

The bottom guide means 50, which guides the motion of the lower part of the bottom panel 4 along the guide rail, is connected to the adjoining guide means 10 via a rigid coupling sectional element 60, whose length corresponds to the height of the bottom panel 4. The coupling sectional element 60 has essentially the form of a hollow I-beam. The upper coupling plates 30 and 38 are, by means of a screw 62, fixedly connected to the upper end of the coupling sectional element 60, and the lower coupling plates 54 and 56 are, by means of a screw 64, fixedly connected to the lower end of the coupling sectional element 60. FIG. 1 shows at the top how a corresponding coupling device is adapted to be connected between the guide means 10 and the next, superjacent guide means.

The hinge plate 40, which is mounted on the bush 18 for rotation around the axis A, can rotate relative to the plates 30 and 38 and, thus, relative to the coupling sectional element 60 and the bottom guide means 50. This rotation of the hinge plate is, however, normally blocked by a releasable joint, as will be discussed below. The end of the hinge plate 40 is inserted and screwed into a groove (see FIG. 3) of a hinge sectional element 66, whose length corresponds with the length of the coupling sectional element 60 and which, when said releasable joint is not released, extends in parallel with and immediately adjacent the coupling sectional element 60, as shown in FIGS. 1 and 3.

A mounting element 68 is inserted and locked in the lower end of the groove of the hinge sectional element 66 and projects a distance below the hinge sectional element 66. A locking plate 70 is, by means of a screw 72, two washers 74 and a nut 76, rotatably connected with the mounting element 68. The nut 76 is tightened to such an extent that the locking plate 70 can be rotated only if a certain frictional moment is overcome, the desired release force being set by adjusting the nut 76.

The locking plate 70 has in its end facing away from the screw 72 a groove 78, which at one end is open and in which the end of the screw 52 is received. As is evident from FIG. 1, a collar nut 80 is screwed to the outer end of the screw 72 so as to form a groove for receiving the locking plate 70.

As shown in FIGS. 1 and 2, the bottom panel 4 is, along its terminal edge 4', supported by the hinge sectional element 66. If the bottom panel 4 is subjected to lateral forces owing to an impact, the lateral forces will be transmitted to the locking plate 70, which implies that the releasable joint is released by rotation of the locking plate 70, whereby the groove 78 can be disengaged from the screw 52 such that the hinge sectional element 66 and, thus, the bottom panel 4 can swing out in the direction of impact.

It is understood that it is possible, in the construction in FIGS. 1–3, to connect a pulling means, such as chain or a rope included in a balancing and/or drive device, to the rigid connection between the guide means 10 and 50, for example to the screw 52. The balancing and/or drive function will thus be completely unaffected by a possible release of the releasable joint 70/52 and the swinging out of the bottom panel 4, and a continued operation of the door will therefore be possible also in such a condition.

The resetting of the bottom panel 4 and the releasable joint after being subjected to an impact obviously is very simple and quick to accomplish.

Figure 5:
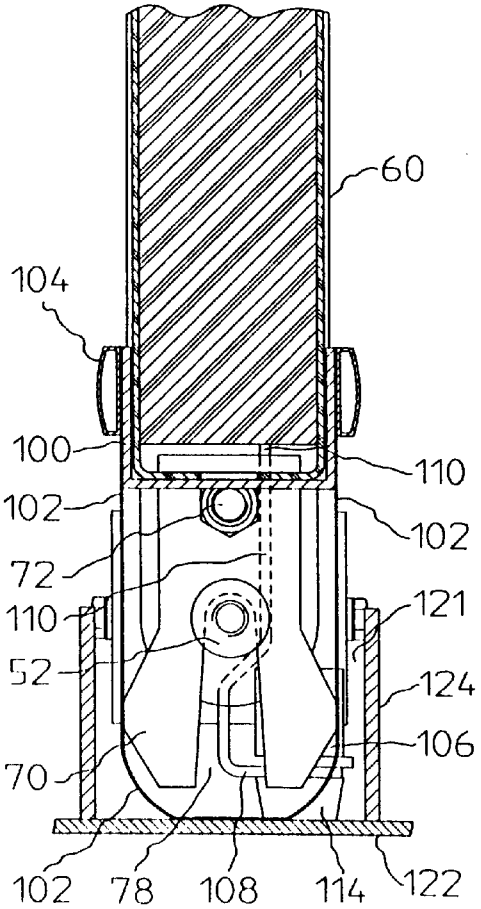
FIG. 5 is a side view of the embodiment in FIG. 4, taken along line V—V.
Figure 4:
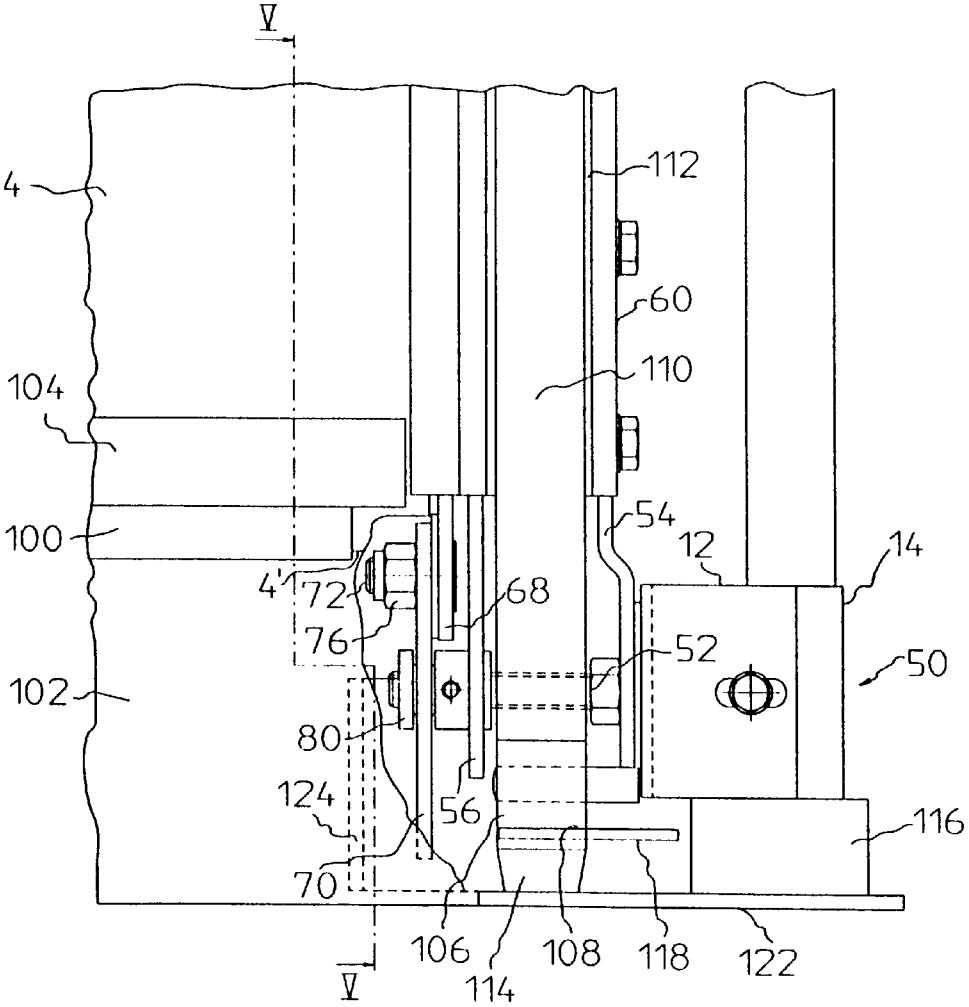
FIG. 4,is a broken-away front view of the embodiment in FIGS. 1–3, supplemented with additional components.

Reference is now made to FIGS. 4 and 5, which illustrate the construction in FIGS. 1–3 supplemented with additional components. First, the bottom panel 4 is, at its lower edge 4", provided with a U-shaped reinforcing sectional element 100 of aluminium, which extends along the entire lower edge of the bottom panel 4 to make this more resistant to impact. Moreover, a per se known, bagshaped sealing device 102 of a plastics-coated fabric is, at the lower edge of the bottom panel 4, attached to plastic strips 104.

The construction in FIGS. 4 and 5 is further supplemented with a safety device for emitting an infrared beam under and parallel to the sealing device 102, said safety device being adapted to stop or reverse the door, if the beam is interrupted during the closing motion. The safety device comprises an infrared radiator on one side of the door, and an infrared detector on the other side of the door. The component 106 schematically illustrated in FIGS. 4 and 5 can thus consist of, for example, the infrared radiator, the infrared detector being correspondingly positioned on the opposite side of the door. The infrared radiator 106 is mounted on a lower part 108 of a vertically movable sliding rail 110, which is vertically displaceably mounted in the space of the coupling sectional element 60, that is designated 112 in FIGS. 3 and 5.

The door is shown in its closed position in FIGS. 4 and 5, and when it begins to move upwards when opening, the sliding rail 110 will move downwards a distance relative to the panel, whereby the infrared radiator 106 will be positioned on a level below the lower edge of the sealing device 102 so as to be able to emit said infrared beam to the infrared detector, which is correspondingly mounted which will be positioned on the same level as the infrared radiator 112. For this safety device preferably is that disclosed in U.S. Pat. No. 4,953,608, the disclosure of which is incorporated by reference, and comprises a photoelectric cell, a displaceable cell support arm which is slidably mounted in a tubular holder, a stop limit edge designed to determine the lower position of the arm, and an abutment which is designed to abut against the floor when the door leaf is approaching and in its fully door-closing position.

Damping blocks 114 and 116 are arranged under the guide means 50 and the lower part 108 of the guide rail 110, respectively. A holder 118 serves to position the wiring to the infrared safety device.

For preventing impermissible or unintentional swinging-out of the bottom panel 4 when the door is closed, the construction in FIGS. 4 and 5 is supplemented with an upwardly open space 121 at the bottom plate 122, defined by a wall 124. When the door is in its closed position, as shown in FIGS. 4 and 5, the locking plate 70 is positioned in the space 121, which prevents rotation of the locking plate 70 and, thus, release of the joint.

Figure 6:
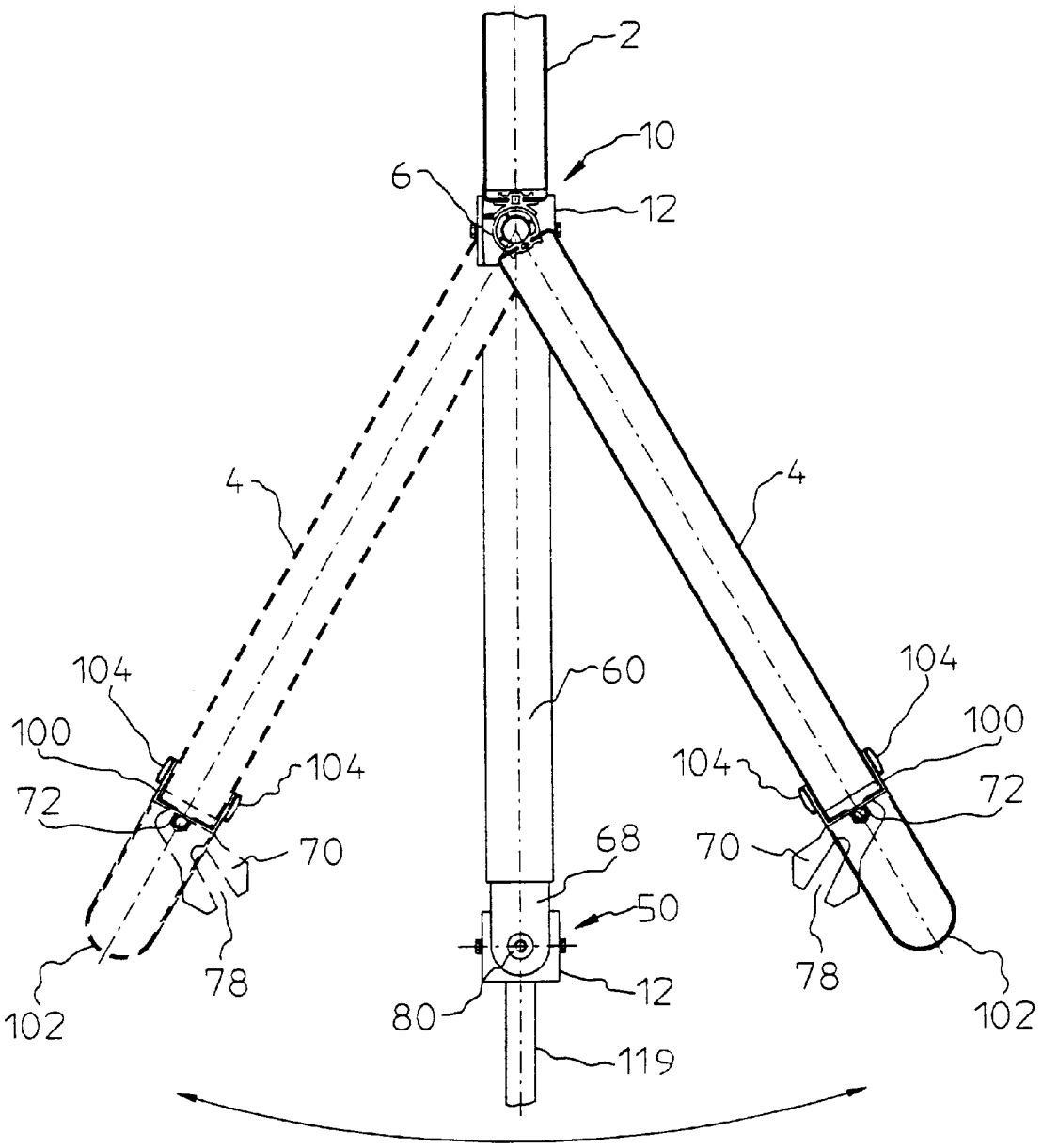
FIG. 6 is a side view showing the bottom panel in FIGS. 4 and 5 in a swung-out position.

FIG. 6 shows by full and dashed lines how the bottom panel 4, when subjected to an impact, can pivot outwards in one or the other direction. It should be particularly noted that the link element 6 in this embodiment of the invention is center relative to the panels 2 and 4 in the direction of thickness thereof. Reference numeral 119 in FIG. 6 designates the above-mentioned guiding rail which is received in the groove 16 of the guide block 14.

The above-described embodiment of the invention can be modified in various ways, without deviating from that defined in the accompanying claims.

A possible modification is to divide the bottom panel 4 into a plurality of separately pivotable parts beside each other, interconnected by means of convenient releasable joints. A further possibility is to manufacture the bottom panel 4 from two fixed edge panels and one or more intermediate, pivotable panels connected to the edge panels by means of convenient releasable joints. The bottom panel 4 can also be made with a greater height than the remaining panels. A possible variant is to make the bottom panel 4 and the adjoining panel 2 function together as a pivotable door section relative to the other panels.

Other types of releasable joints than the one shown above are useful for the invention, for example spring-loaded pins, breakable joints etc.

The door can, if necessary, be supplemented with means adapted to sense when the bottom panel 4 is swung out and then stop or reverse the door and/or produce an alarm signal.

The sliding rail 110 for the infrared safety device can also be slidingly mounted in the guide blocks 14 in the vertical groove of each block, which in FIG. 3 is designated 120.

In a possible modification of the above described embodiment, the bottom panel 4 may consist of a central, pivotable part and two fixed lateral parts. The lateral parts may then be considered to constitute part of the respective coupling element 60. The releasable joint can then be moved closer to the centre of the door leaf to a corresponding degree.

We claim:

1. A door, comprising:

two parallel guide rails;

a plurality of separate guide means which during movement of the door, are guided by and run along said guide rails, wherein a mutual distance alone each guide rail between adjacent ones of said guide means is essentially constant during movement of the door;

a plurality of neighbouring panels extending between the guide rails and being pivotably connected to each other at adjacent longitudinal edges of said door leaf panels, and wherein opposite ends of each door leaf panel are connected to an associated guide means of said plurality of guide means;

a bottom panel, which is pivotally connected to an adjoining panel of said door leaf panels and which bottom panel is, via releasable joints, connected to two associated bottom guide means among said guide means;

two coupling elements, wherein said two bottom guide means are each connected to an adjoining guide means of said adjoining door leaf panel by means of a respective one of said coupling elements; and wherein said releasable joints are arranged between said coupling element on one hand and said bottom panel on the other hand, such that said bottom panel, if subjected to such load that said releasable joints are released, can swing outwards relative said adjoining door leaf panel, while said coupling elements and said bottom guide means are kept in position relative to the remaining guide means and door leaf panels.

2. The door as claimed in claim 1, characterised in that said coupling element (60) is formed as a rigid body.

3. The door as claimed in claim 1, characterised in that said coupling element is connected to safety means which are adapted to emit, under and at a distance from the closing edge (102) of said door, a light beam or the like.

4. The door as claimed in claim 1, characterised in that said releasable joint is a friction joint.

5. The door as claimed in claim 4, characterised in that said releasable joint comprises a combination of a pin and a locking plate, said locking plate having a groove open at one end and adapted to receive said pin in the non-pivoted normal position of said bottom panel and which is so rotatable, while overcoming a friction moment, that said pin can leave the groove of said locking plate, if said locking plate is rotated a predetermined angle relative to said normal position.

6. The door as claimed in claim 1, characterised by a hinge plate (40, 66) arranged at the respective coupling element (60), said hinge plate being rotatably connected to said coupling element (60) and extending along a corresponding terminal edge (4') of said bottom panel (4) and being connected thereto.

7. The door as claimed in claim 6, characterised in that it further comprises a locking means (121, 124), which is arranged at a lower part (122) of the door opening and adapted, when said door is closed, to prevent swinging out of said bottom panel (4).

8. The door as claimed in claim 7, characterised in that said locking means is arranged at the surface against which the door leaf closes, said locking means forming an upwardly open space for receiving one of said hinge plate and said locking plate, when closing the door.

* * * * *